US012043939B2

(12) United States Patent
Dedow et al.

(10) Patent No.: US 12,043,939 B2
(45) Date of Patent: Jul. 23, 2024

(54) WASHING MACHINE APPLIANCES AND METHODS OF OPERATION

(71) Applicant: Haier US Appliance Solutions, Inc., Wilmington, DE (US)

(72) Inventors: Gregory Allen Dedow, Louisville, KY (US); Martin Ortega Brena, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 848 days.

(21) Appl. No.: 17/068,977

(22) Filed: Oct. 13, 2020

(65) Prior Publication Data

US 2022/0112643 A1 Apr. 14, 2022

(51) Int. Cl.

| | |
|---|---|
| ***D06F 33/48*** | (2020.01) |
| ***D06F 23/02*** | (2006.01) |
| ***D06F 34/16*** | (2020.01) |
| *D06F 103/26* | (2020.01) |
| *D06F 105/48* | (2020.01) |

(52) U.S. Cl.

CPC ..... *D06F 33/48* (2020.02); *D06F 23/02* (2013.01); *D06F 34/16* (2020.02); *D06F 2103/26* (2020.02); *D06F 2105/48* (2020.02)

(58) Field of Classification Search

CPC ..... D06F 33/40; D06F 33/48; D06F 33/60; D06F 33/76; D06F 34/16; D06F 34/18; D06F 2103/00; D06F 2103/02; D06F 2103/04; D06F 2103/24; D06F 2103/26; D06F 2105/46; D06F 2105/48; D06F 2105/52

See application file for complete search history.

(56) References Cited

U.S. PATENT DOCUMENTS

| | | | |
|---|---|---|---|
| 5,671,494 | A | 9/1997 | Civanelli et al. |
| 6,374,444 | B2 | 4/2002 | Skrippek et al. |
| 6,578,225 | B2 | 6/2003 | Jonsson |
| 7,530,133 | B2 | 5/2009 | Mitts |
| 7,752,694 | B2 | 7/2010 | Koo |
| 8,122,549 | B2 | 2/2012 | Choi |
| 8,176,798 | B2 | 5/2012 | Ashrafzadeh et al. |
| 8,215,134 | B2 | 7/2012 | Ashrafzadeh et al. |
| 8,381,569 | B2 | 2/2013 | Lilie et al. |
| 8,679,198 | B2 | 3/2014 | Bae et al. |

(Continued)

FOREIGN PATENT DOCUMENTS

| | | | |
|---|---|---|---|
| EP | 1857583 | A1 | 11/2007 |
| EP | 2765230 | A1 | 8/2014 |

(Continued)

*Primary Examiner* — David G Cormier

(74) *Attorney, Agent, or Firm* — Dority & Manning, P.A.

(57) ABSTRACT

A method of operating a washing machine appliance includes calculating a plaster speed of a load of articles in a basket, rotating the basket, and accelerating the basket to a first speed less than the calculated plaster speed and greater than zero during an initial ramp period. The method also includes accelerating the basket from the first speed to a second speed greater than the first speed. The second speed is within a predetermined margin of the calculated plaster speed. The method further includes monitoring a balance condition and accelerating the basket to full plaster speed when the monitored balance condition is within a predetermined tolerance range.

18 Claims, 10 Drawing Sheets

(56) References Cited

U.S. PATENT DOCUMENTS

| | | | | |
|---|---|---|---|---|
| 8,726,440 | B2 | 5/2014 | Bolduan et al. | |
| 8,938,835 | B2 | 1/2015 | Bae et al. | |
| 8,984,693 | B2 | 3/2015 | Ashrafzadeh et al. | |
| 9,279,206 | B2 | 3/2016 | Ashrafzadeh et al. | |
| 9,493,897 | B2 | 11/2016 | Borlin | |
| 9,873,968 | B2 | 1/2018 | Janke | |
| 10,214,844 | B2 | 2/2019 | Davis | |
| 2005/0102766 | A1 | 5/2005 | Miller | |
| 2006/0185095 | A1* | 8/2006 | Mitts | D06F 34/18 8/158 |
| 2006/0242768 | A1 | 11/2006 | Buendia | |
| 2014/0215725 | A1 | 8/2014 | Paglia | |
| 2017/0327988 | A1* | 11/2017 | K | G01M 1/16 |
| 2019/0242047 | A1 | 8/2019 | Dedow et al. | |

FOREIGN PATENT DOCUMENTS

| | | | |
|---|---|---|---|
| EP | 1995366 | B1 | 5/2015 |
| JP | 2008061856 | A | 3/2008 |
| JP | 2010194078 | A | 9/2010 |
| JP | 2011101667 | A | 5/2011 |
| JP | 2013027448 | A | 2/2013 |
| JP | 5380320 | B2 | 1/2014 |
| WO | WO2012114716 | A1 | 8/2012 |
| WO | WO2018076082 | A1 | 5/2018 |

* cited by examiner

WASHING MACHINE APPLIANCES AND METHODS OF OPERATION

FIELD OF THE INVENTION

The present subject matter relates generally to washing machine appliances, and methods for monitoring load balances in such washing machine appliances.

BACKGROUND OF THE INVENTION

Washing machine appliances generally include a wash tub for containing water or wash fluid (e.g., water and detergent, bleach, or other wash additives). A basket is rotatably mounted within the wash tub and defines a wash chamber for receipt of articles for washing. During normal operation of such washing machine appliances, the wash fluid is directed into the wash tub and onto articles within the wash chamber of the basket. The basket or an agitation element can rotate at various speeds to agitate articles within the wash chamber, to wring wash fluid from articles within the wash chamber, etc. Washing machine appliances include vertical axis washing machine appliances and horizontal axis washing machine appliances, where "vertical axis" and "horizontal axis" refer to the axis of rotation of the wash basket within the wash tub.

A significant concern during operation of washing machine appliances is the balance of the tub during operation. For example, articles and water loaded within a basket may not be equally weighted about a central axis of the basket and tub. Accordingly, when the basket rotates, in particular during a spin cycle, the imbalance in clothing weight may cause the basket to be out-of-balance within the tub, such that the axis of rotation does not align with the cylindrical axis of the basket or tub. Such out-of-balance issues can cause the basket to contact the tub during rotation, and can further cause movement of the tub within the cabinet. Significant movement of the tub can, in turn, cause excessive noise, vibration or motion, or damage to the appliance.

Various methods are known for monitoring load balances and preventing out-of-balance scenarios within washing machine appliances. Such monitoring and prevention may be especially important, for instance, during the high-speed rotation of a plaster phase of a spin cycle that ensures water is shed from articles within the tub. Typical systems guess when articles within the tub are in a suitable position for the plaster phase based on monitored motor current or rotational velocity. One or more balancing rings may be attached to the rotating basket to provide a rotating annular mass that minimizes the effects of imbalances. However, such systems may fail to accurately determine the position of articles within the tub or basket. Moreover, in the case of balancing rings, such systems may increase the amount of energy or torque required to rotate the basket, thereby decreasing efficiency.

Accordingly, improved methods and apparatuses for monitoring load balance in washing machine appliances are desired. In particular, methods and apparatuses that provide for accurate detection of a balanced state or compensation for an imbalanced state during a washing operation would be advantageous.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a washing machine appliance is provided. The washing machine appliance has a tub and a basket rotatably mounted within the tub. The method includes calculating a plaster speed of a load of articles in the basket. The method also includes rotating the basket and accelerating the basket to a first speed less than the calculated plaster speed by a first margin. The method further includes accelerating the basket from the first speed to a second speed greater than the plaster speed by a second margin. During the step of accelerating the basket from the first speed to the second speed, the method includes monitoring a balance condition of the load of articles in the basket. The method further includes accelerating the basket to a full plaster speed when the monitored balance condition is within a predetermined tolerance range.

In another exemplary aspect of the present disclosure, a method of operating a washing machine appliance is provided. The washing machine appliance has a tub and a basket rotatably mounted within the tub. The method includes calculating a plaster speed of a load of articles in the basket. The method also includes rotating the basket and accelerating the basket to a first speed less than the calculated plaster speed and greater than zero during an initial ramp period. The method further includes accelerating the basket from the first speed to a second speed. The second speed is greater than the first speed and within a predetermined margin of the calculated plaster speed. The method also includes monitoring a balance condition of the load of articles in the basket. The method further includes accelerating the basket to a full plaster speed greater than the calculated plaster speed when the monitored balance condition is within a predetermined tolerance range.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
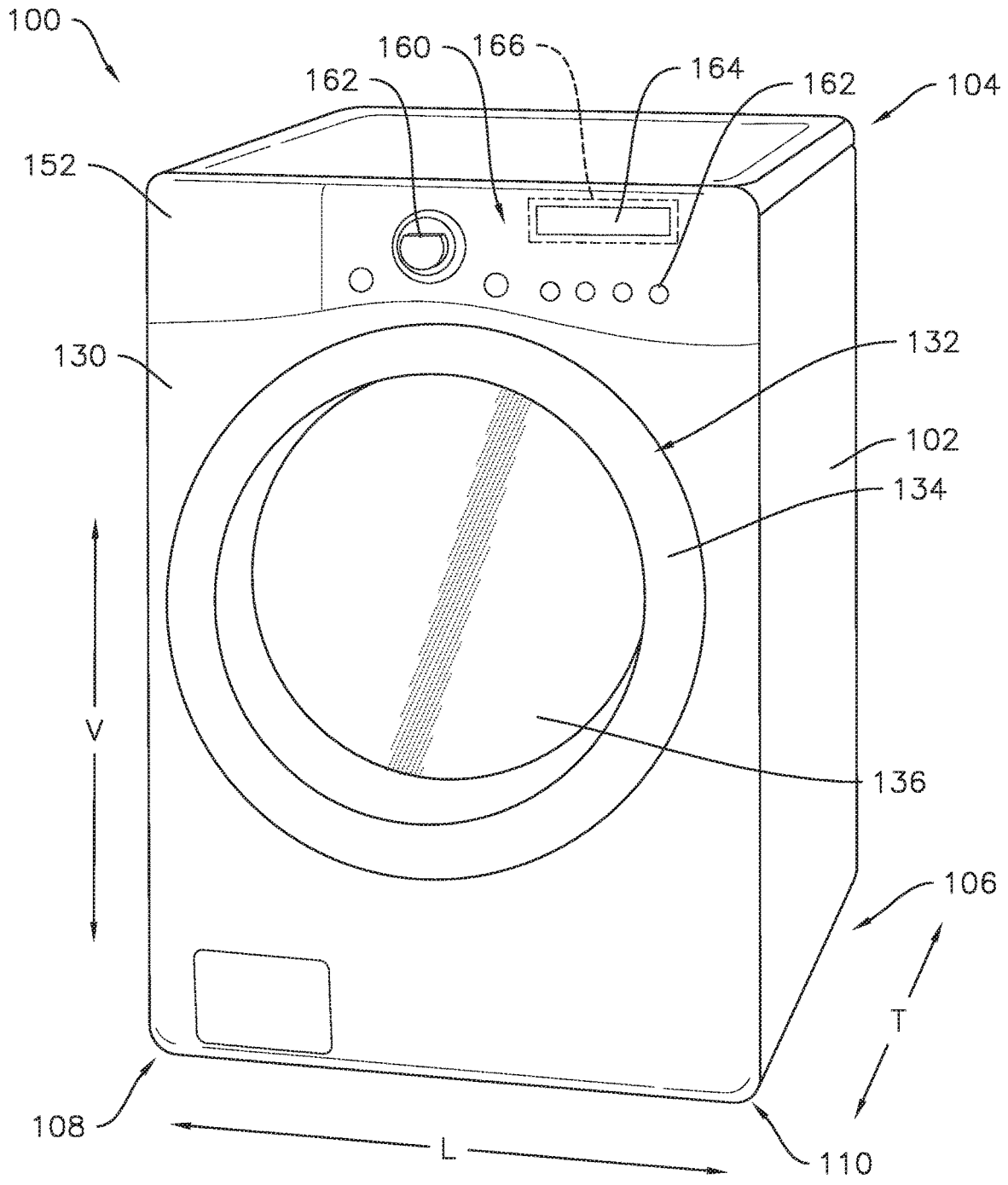
FIG. 1 provides a perspective view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one element from another and are not intended to signify location or importance of the individual elements.

As used herein, terms of approximation, such as "generally," or "about" include values within ten percent greater or less than the stated value, unless otherwise specified. When used in the context of an angle or direction, such terms include within ten degrees greater or less than the stated angle or direction, unless otherwise specified. For example, "generally vertical" includes directions within ten degrees of vertical in any direction, e.g., clockwise or counter-clockwise.

Figure 2:
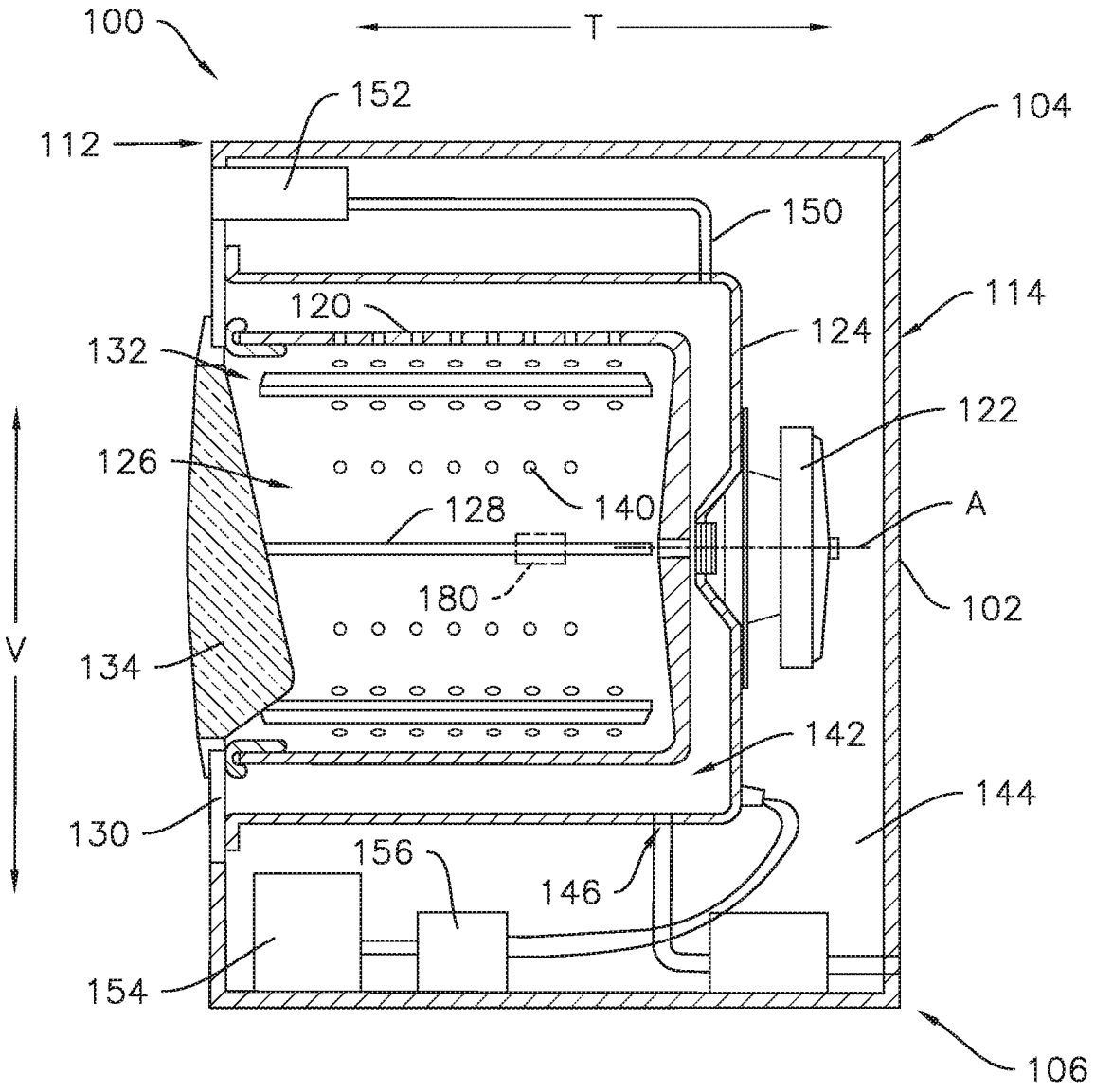
FIG. 2 provides a cross-sectional side view of the exemplary washing machine appliance.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction L, and between a front 112 and a rear 114 along the transverse direction T.

Referring to FIG. 2, a wash tub 124 is positioned within cabinet 102 and is generally configured for retaining wash fluids during an operating cycle. As used herein, "wash fluid" may refer to water, detergent, fabric softener, bleach, or any other suitable wash additive or combination thereof. Wash tub 124 is substantially fixed relative to cabinet 102 such that it does not rotate or translate relative to cabinet 102.

A wash basket 120 is received within wash tub 124 and defines a wash chamber 126 that is configured for receipt of articles for washing. More specifically, wash basket 120 is rotatably mounted within wash tub 124 such that it is rotatable about an axis of rotation A. According to the illustrated embodiment, the axis of rotation is substantially parallel to the transverse direction T. In this regard, washing machine appliance 100 is generally referred to as a "horizontal axis" or "front load" washing machine appliance 100. However, it should be appreciated that aspects of the present subject matter may be used within the context of a vertical axis or top load washing machine appliance as well.

Wash basket 120 may define one or more agitator features that extend into wash chamber 126 to assist in agitation and cleaning of articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Washing machine appliance 100 includes a motor assembly 122 that is in mechanical communication with wash basket 120 to selectively rotate wash basket 120 (e.g., during an agitation or a rinse cycle of washing machine appliance 100). According to the illustrated embodiment, motor assembly 122 is a pancake motor. However, it should be appreciated that any suitable type, size, or configuration of motor may be used to rotate wash basket 120 according to alternative embodiments.

Referring generally to FIGS. 1 and 2, cabinet 102 also includes a front panel 130 that defines an opening 132 that permits user access to wash basket 120 of wash tub 124. More specifically, washing machine appliance 100 includes a door 134 that is positioned over opening 132 and is rotatably mounted to front panel 130 (e.g., about a door axis that is substantially parallel to the vertical direction V). In this manner, door 134 permits selective access to opening 132 by being movable between an open position (not shown) facilitating access to a wash tub 124 and a closed position (FIG. 1) prohibiting access to wash tub 124.

In some embodiments, a window 136 in door 134 permits viewing of wash basket 120 when door 134 is in the closed position (e.g., during operation of washing machine appliance 100). Door 134 also includes a handle (not shown) that, for example, a user may pull when opening and closing door 134. Further, although door 134 is illustrated as mounted to front panel 130, it should be appreciated that door 134 may be mounted to another side of cabinet 102 or any other suitable support according to alternative embodiments. Additionally or alternatively, a front gasket or baffle 138 may extend between tub 124 and the front panel 130 about the opening 132 covered by door 134, further sealing tub 124 from cabinet 102.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of, and generally collects, wash fluid during operation of washing machine appliance 100. For example, during operation of washing machine appliance 100, wash fluid may be urged (e.g., by gravity) from basket 120 to sump 142 through the plurality of perforations 140. A pump assembly 144 is located beneath wash tub 124 for gravity assisted flow when draining wash tub 124 (e.g., via a drain 146). Pump assembly 144 is also configured for recirculating wash fluid within wash tub 124.

Figure 3:
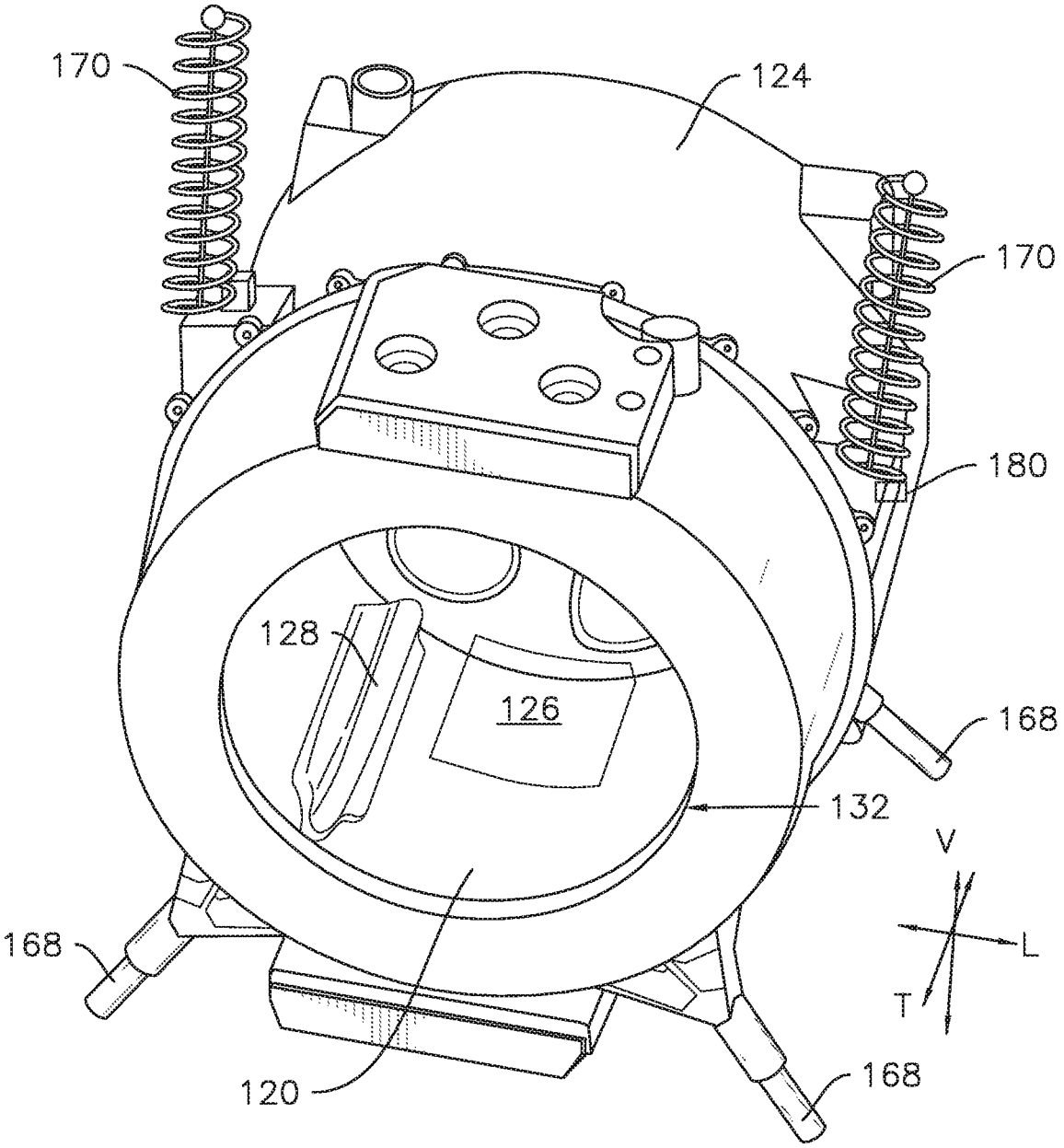
FIG. 3 provides a perspective view of a portion of the exemplary washing machine appliance, wherein the cabinet has been removed for clarity.
Figure 4:
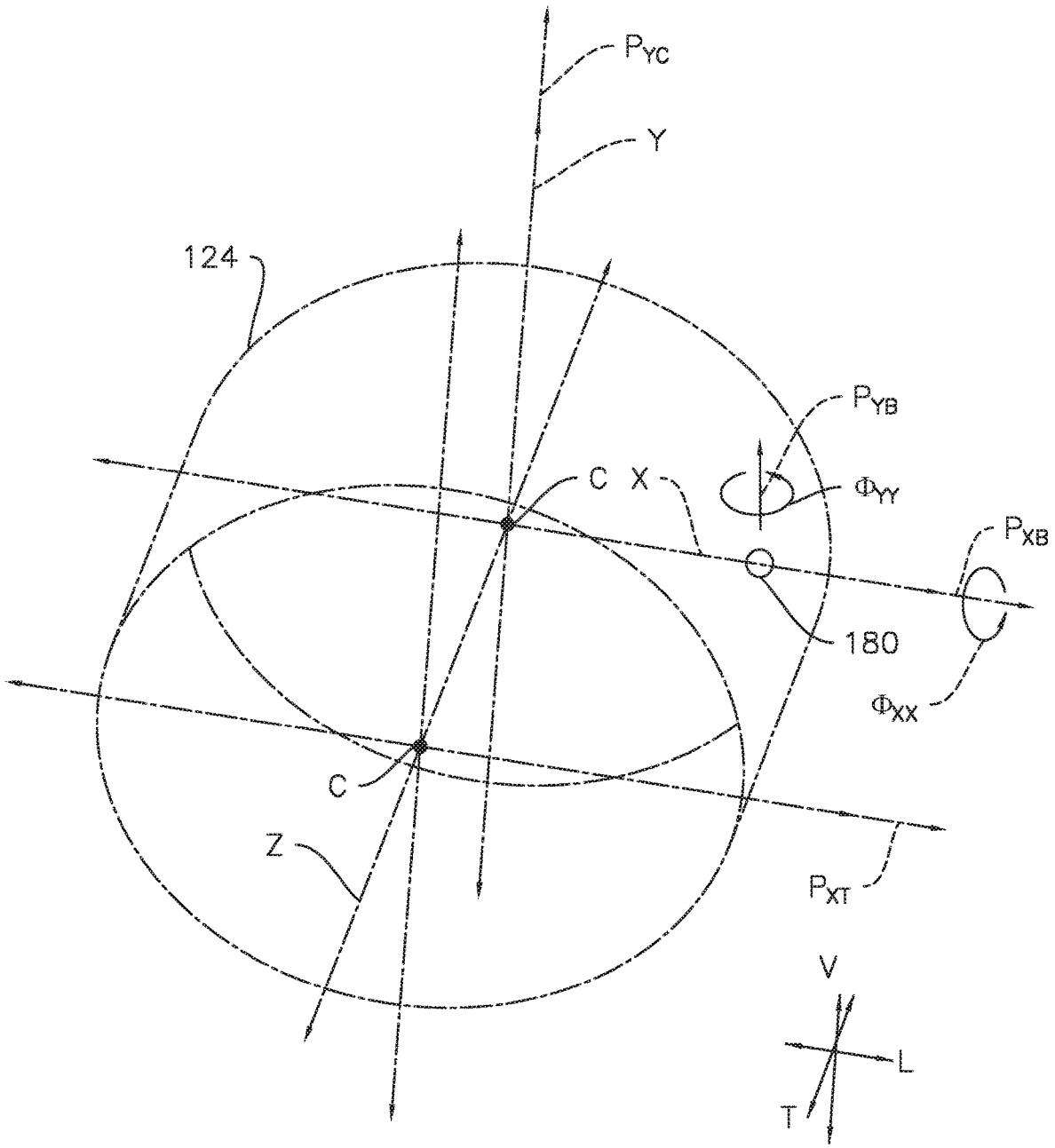
FIG. 4 provides a schematic perspective view of components of a washing machine appliance in accordance with exemplary embodiments of the present disclosure.
Figure 5:
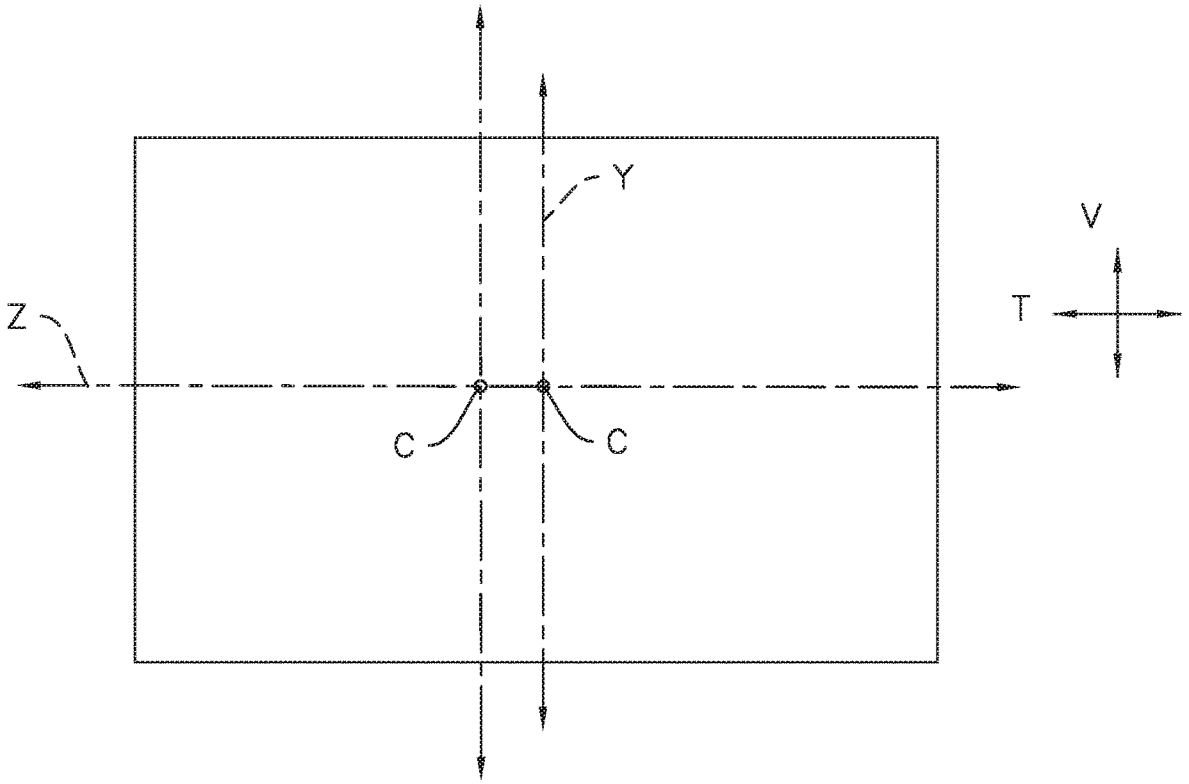
FIG. 5 provides a schematic side view of components of a washing machine appliance in accordance with exemplary embodiments of the present disclosure.
Figure 6:
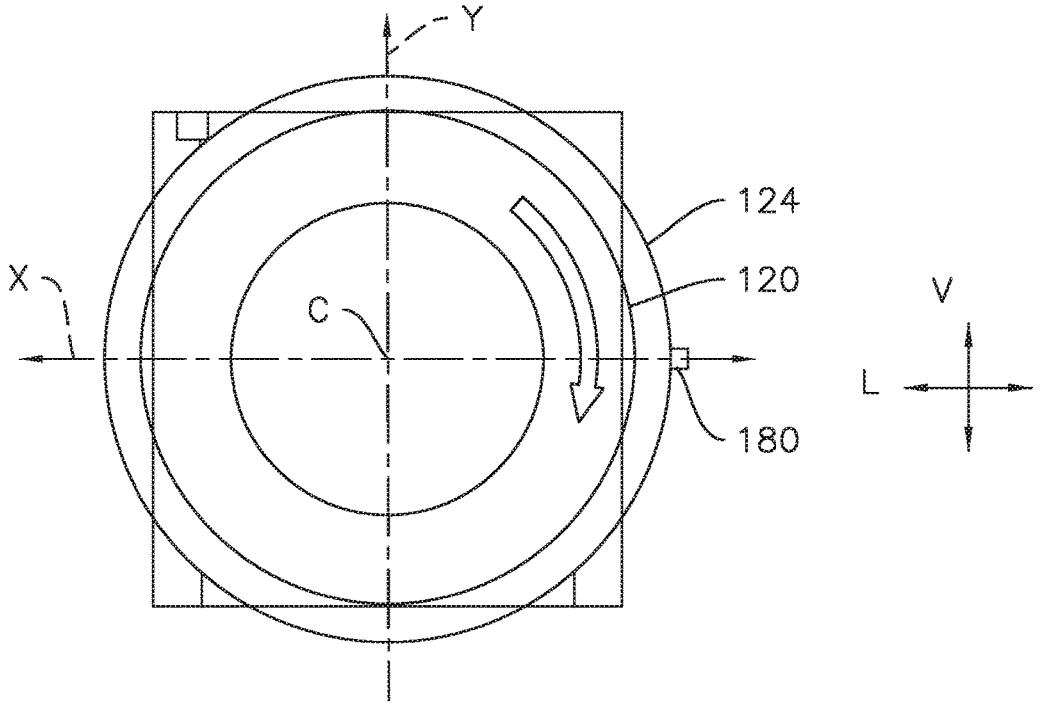
FIG. 6 provides a schematic front view of components of a washing machine appliance in accordance with exemplary embodiments of the present disclosure.

Turning briefly to FIG. 3, basket 120, tub 124, and machine drive system 148 are supported by a vibration damping system. The damping system generally operates to damp or reduce dynamic motion as the wash basket 120 rotates within the tub 124. The damping system can include one or more damper assemblies 168 coupled between and to the cabinet 102 and wash tub 124 (e.g., at a bottom portion of wash tub 124). Typically, four damper assemblies 168 are utilized, and are spaced apart about the wash tub 124. For example, each damper assembly 168 may be connected at one end proximate to a bottom corner of the cabinet 102. Additionally or alternatively, the washer can include other vibration damping elements, such as one or more suspension assemblies 170 positioned above basket 120 and attached to tub 124 at a top portion thereof. In optional embodiments, the vibration damping system (and washing machine appliance 100, generally) is free of any annular balancing rings, which would add an evenly-distributed rotating mass on basket 120. Thus, the rotating mass of the basket 120 may be relatively low, advantageously reducing the amount of energy or torque required to rotate basket 120.

Returning to FIGS. 1 and 2, in some embodiments, washing machine appliance 100 includes an additive dispenser or spout 150. For example, spout 150 may be in fluid communication with a water supply (not shown) in order to direct fluid (e.g., clean water) into wash tub 124. Spout 150 may also be in fluid communication with the sump 142. For example, pump assembly 144 may direct wash fluid disposed in sump 142 to spout 150 in order to circulate wash fluid in wash tub 124.

As illustrated, a detergent drawer 152 may be slidably mounted within front panel 130. Detergent drawer 152 receives a wash additive (e.g., detergent, fabric softener, bleach, or any other suitable liquid or powder) and directs the fluid additive to wash chamber 126 during operation of washing machine appliance 100. According to the illustrated embodiment, detergent drawer 152 may also be fluidly coupled to spout 150 to facilitate the complete and accurate dispensing of wash additive.

In optional embodiments, a bulk reservoir 154 is disposed within cabinet 102. Bulk reservoir 154 may be configured for receipt of fluid additive for use during operation of washing machine appliance 100. Moreover, bulk reservoir 154 may be sized such that a volume of fluid additive sufficient for a plurality or multitude of wash cycles of washing machine appliance 100 (e.g., five, ten, twenty, fifty, or any other suitable number of wash cycles) may fill bulk reservoir 154. Thus, for example, a user can fill bulk reservoir 154 with fluid additive and operate washing machine appliance 100 for a plurality of wash cycles without refilling bulk reservoir 154 with fluid additive. A reservoir pump 156 is configured for selective delivery of the fluid additive from bulk reservoir 154 to wash tub 124.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, or other items of interest to machine users.

Operation of washing machine appliance 100 is controlled by a controller or processing device 166 that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory (e.g., non-transitive memory) and microprocessor, such as a general or special purpose microprocessor operable to execute programming instructions or micro-control code associated with a wash operation. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 160 and other components of washing machine appliance 100, such as motor assembly 122 and measurement device 180 (discussed herein), may be in communication with controller 166 via one or more signal lines or shared communication busses. Optionally, measurement device 180 may be included with controller 166. Moreover, measurement devices 180 may include a microprocessor that performs the calculations specific to the measurement of motion with the calculation results being used by controller 166. It should be noted that controllers as disclosed herein are capable of and may be operable to perform any methods and associated method steps as disclosed herein. For example, in some embodiments, methods disclosed herein may be embodied in programming instructions stored in the memory and executed by the controller.

In exemplary embodiments, during operation of washing machine appliance 100, laundry items are loaded into wash basket 120 through opening 132, and a wash operation is initiated through operator manipulation of input selectors 162. For example, a wash cycle may be initiated such that wash tub 124 is filled with water, detergent, or other fluid additives (e.g., via additive dispenser 150). One or more valves (not shown) can be controlled by washing machine appliance 100 to provide for filling wash basket 120 to the appropriate level for the amount of articles being washed or rinsed. By way of example, once wash basket 120 is properly filled with fluid, the contents of wash basket 120 can be agitated (e.g., with ribs 128) for an agitation phase of laundry items in wash basket 120. During the agitation phase, the basket 120 may be motivated about the axis of rotation A at a set speed (e.g., a tumble speed). As the basket 120 is rotated, articles within the basket 120 may be lifted and permitted to drop therein.

After the agitation phase of the washing operation is completed, wash tub 124 can be drained. Laundry articles can then be rinsed (e.g., through a rinse cycle) by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle or after the rinse cycle in order to wring wash fluid from the articles being washed. During a spin cycle, basket 120 is rotated at relatively high speeds. For instance, basket 120 may be rotated at one set speed (e.g., a pre-plaster speed) before being rotated at another set speed (e.g., a plaster speed). As would be understood, the pre-plaster speed may be greater than the tumble speed and the plaster speed may be greater than the pre-plaster speed. Moreover, agitation or tumbling of articles may be reduced as basket 120 increases its rotational velocity such that the plaster speed maintains the articles at a generally fixed position relative to basket 120.

After articles disposed in wash basket 120 are cleaned (or the washing operation otherwise ends), a user can remove the articles from wash basket 120 (e.g., by opening door 134 and reaching into wash basket 120 through opening 132).

Referring now to FIGS. 3 through 6, one or more measurement devices 180 may be provided in the washing machine appliance 100 for measuring movement of the tub 124, in particular during rotation of articles in the spin cycle of the washing operation. Measurement devices 180 may measure a variety of suitable variables that can be correlated to movement of the tub 124. The movement measured by such devices 180 can be utilized to monitor the load balance state of the tub 124 and to facilitate agitation in particular manners or for particular time periods to adjust the load balance state (i.e., as an attempt to balance articles within the basket 120).

A measurement device 180 in accordance with the present disclosure may include an accelerometer which measures translational motion, such as acceleration along one or more directions. Additionally or alternatively, a measurement device 180 may include a gyroscope, which measures rotational motion, such as rotational velocity about an axis. A measurement device 180 in accordance with the present disclosure is mounted to the tub 124 (e.g., on a sidewall of tub 124) to sense movement of the tub 124 relative to the cabinet 102 by measuring uniform periodic motion, non-uniform periodic motion, or excursions of the tub 124 during appliance 100 operation. For instance, movement may be measured as discrete identifiable components (e.g., in a predetermined direction).

In exemplary embodiments, a measurement device 180 may include at least one gyroscope or at least one accelerometer. The measurement device 180, for example, may be a printed circuit board that includes the gyroscope and accelerometer thereon. The measurement device 180 may be mounted to the tub 124 (e.g., via a suitable mechanical fastener, adhesive, etc.) and may be oriented such that the various sub-components (e.g., the gyroscope and accelerometer) are oriented to measure movement along or about particular directions as discussed herein. Notably, the gyroscope and accelerometer in exemplary embodiments are advantageously mounted to the tub 124 at a single location (e.g., the location of the printed circuit board or other component of the measurement device 180 on which the gyroscope and accelerometer are grouped). Such positioning at a single location advantageously reduces the costs and complexity (e.g., due to additional wiring, etc.) of out-of-balance detection, while still providing relatively accurate out-of-balance detection as discussed herein. Alternatively, however, the gyroscope and accelerometer need not be mounted at a single location. For example, a gyroscope located at one location on tub 124 can measure the rotation of an accelerometer located at a different location on tub 124, because rotation about a given axis is the same everywhere on a solid object such as tub 124.

As illustrated, tub 124 may define an X-axis, a Y-axis, and a Z-axis that are mutually orthogonal to each other. The Z-axis may extend along a longitudinal direction, and may thus be coaxial or parallel with the axis of rotation A (FIG. 2) when the tub 124 and basket 120 are balanced. Movement of the tub 124 measured by measurement device(s) 180 may, in exemplary embodiments, be measured (e.g., approximately measured) as a displacement amplitude or value.

In some embodiments, movement is measured as a plurality of unique displacement values. Optionally, the displacement values may occur in discrete channels of motion (e.g., as distinct directional components of movement). For instance, displacement values may correspond to one or more indirectly measured movement components perpendicular or approximately perpendicular to a center C (e.g., geometric center of gravity based on the shape and mass of tub 124 in isolation) of the tub 124. Such movement components may, for example, occur in a plane defined by the X-axis and Y-axis (i.e., the X-Y plane) or in a plane perpendicular to the X-Y plane. Movement of the tub 124 along the particular direction may be calculated using the indirect measurement component and other suitable variables, such as a horizontal or radial offset distance along the vector from the measurement device 180 to the center C of the tub 124. Additionally or alternatively, the displacement values may correspond to one or more directly measured movement components. Such movement components may, for example, occur in the X-Y plane or in a plane perpendicular to the X-Y plane.

The measured movement of the tub 124 in accordance with exemplary embodiments of the present disclosure, such as those requiring one or more gyroscopes and one or more accelerometers, may advantageously be calculated based on the movement components measured by the accelerometer or gyroscope of the measurement device(s) 180. For example, a movement component of the tub 124 may be a linear displacement vector $P_{XB}$ (e.g., a first displacement vector) of center C in the X-Y plane (e.g., along the lateral direction L). Displacement vector $P_{XB}$ may be calculated from detected movement by the accelerometer at measurement device 180 (e.g., via double integration of detected acceleration data). For example, vectors defined in an X-Y plane such as $P_{XB}$ may represent the radius of a substantially circular (e.g., elliptical, orbital, or perfectly circular) motion caused by the rotation of an imbalanced load so that maximum and minimum values of the periodic vector occur as the substantially circular motion aligns with the direction of the vector.

In additional or alternative embodiments, another movement component of tub 124 is obtained at measurement device 180. For instance, a wobble angle $\phi_{YY}$ of angular displacement of the tub 124 may be calculated. Wobble angle $\phi_{YY}$ may represent rotation relative to the axis of rotation A (FIG. 2) such as the angle of deviation of the Z-axis from its static or balanced position around the axis of rotation A. Wobble angle $\phi_{YY}$ may be calculated as a rotation parallel to the Y-axis using movement detected by the gyroscope at measurement device 180 (e.g., via integration of detected rotational velocity data).

In still further additional or alternative embodiments, a movement component of tub 124 may be a linear displacement vector $P_{XT}$ (e.g., a second displacement vector) of a center C' (e.g., effective center of gravity that compensates for biasing or resistance forces on tub 124 from one or more directions) in a plane parallel to the X-Y plane and perpendicular to the axis of rotation A (FIG. 2) (e.g., along the lateral direction L). Displacement vector $P_{XT}$ may thus be separated from the displacement vector $P_{XB}$ along the Z-axis. Optionally, the vector $P_{XT}$ may be calculated from movement detected at the accelerometer or gyroscope at measurement device 180. For example, displacement vector $P_{XT}$ may be calculated as a cross-product (e.g., the rotation at $\phi_{YY}$ times the transverse offset distance between measurement device 180 and C') added to another displacement vector (e.g., $P_{XB}$).

Notably, the term "approximately" as utilized with regard to the orientation and position of such movement measurements denotes ranges such as of plus or minus 2 inches or plus or minus 10 degrees relative to various axes passing through the basket center C which minimizes, for example, the contribution to error in the measurement result by rotation about the Z-axis, as might be caused, for example, by a torque reaction to motor assembly 122.

Further, and as discussed, the measurement device 180 need not be in the X-Y plane in which movement (e.g., at the center C) is calculated. For example, measurement device 180 may additionally be offset by an offset distance along the Z-axis. In one particular example, a measurement device 180 mounted to or proximate a suspension assembly 170 may be utilized to indirectly measure movement of the center C in an X-Y plane at or proximate the top of the tub 124. Additionally or alternatively, a measurement device 180 can be mounted close to or on the Z-axis or may be used to calculate motion that is not on the axis of rotation A (FIG. 2).

In some embodiments, an out-of-balance (OOB) value may be determined, at least in part, from the movement measured from measurement device 180. For instance, controller 166 may correlate displacement (e.g., as measured in inches) and rotational velocity (e.g., as measured at motor assembly 122 in rotations per minute) to an OOB value, such as a value of weight or mass (e.g., in pounds-mass). Advantageously, the determined OOB value may provide an accurate indicator of an imbalance that accounts for both displacement and rotation. In some such embodiments, a predetermined graph, table, or transfer function may be provided to determine a specific OOB value using a known or measured displacement value and rotational velocity. The predetermined graph, table, or transfer function may be determined from experimental data and, optionally, included within controller 166.

As an example, the OOB value may be determined from a transfer function provided as $$OOB=P_{XT}*(Q_1*V_R+Q_2)+(Q_3*V_R)-Q_4$$

wherein:

$P_{XT}$ is a measured displacement;

$V_R$ is a measured or otherwise known rotational velocity; and $Q_1$, $Q_2$, $Q_3$, and $Q_4$ are each unique predetermined coefficients relating to the corresponding washer appliance.

In optional embodiments, controller 166 may gather multiple OOB values (e.g., continuously or over a set period of time). From these multiple OOB values, controller 166 may determine a rate of change for the OOB values. For instance, controller 166 may calculate a rate of change across multiple OOB values spanning a sub-period of time. Additionally or alternatively, controller 166 may graph the OOB values and determine a slope of the graphed values at a specific point in time. Thus, in various embodiments, a relative displacement value or relative OOB value may be calculated based on one or both of the rate of change and/or the slope.

Figure 7:
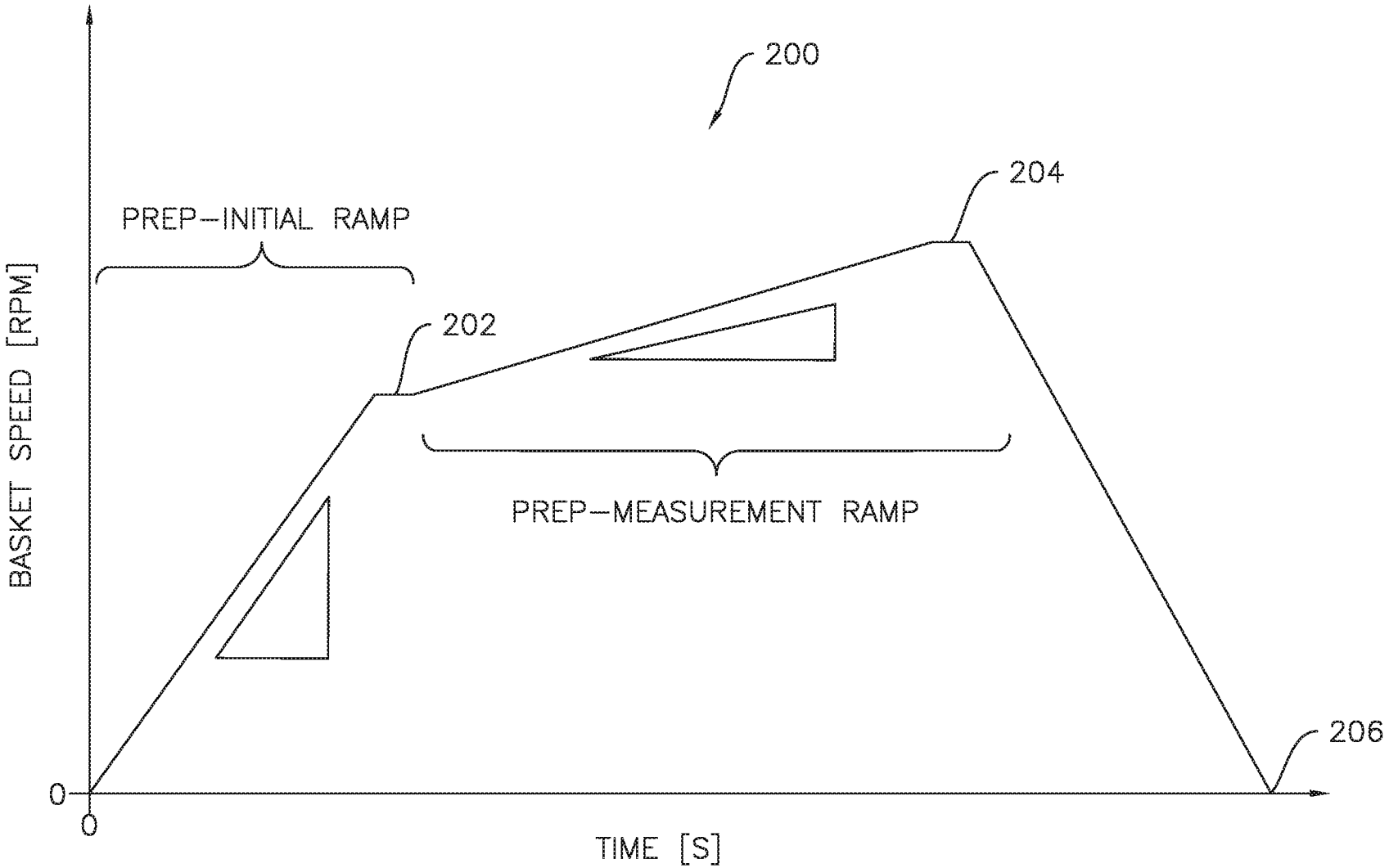
FIG. 7 provides a graph of rotational speed over time during a prep step of an exemplary operation of a washing machine appliance according to one or more exemplary embodiments of the present disclosure.

FIG. 7 provides a graph of rotational speed over time during a prep step 200 of an exemplary operation of a washing machine appliance. The prep step 200 may be used to determine or calculate a plaster speed, such as a first plaster speed, of a load of articles in the wash basket 120. As shown in FIG. 7, the prep step may include an initial ramp phase and a measurement ramp phase. During the initial ramp phase, the speed of rotation of the basket 120 increases, or ramps up, from zero to a first prep speed 202. When the first prep speed 202 has been reached, the measurement ramp phase begins. During the measurement ramp phase, the speed of the basket 120 increases more gradually (as compared to the initial ramp phase), such as by about 5 RPM/second or less, such as about 2 RPM/second, such as about 1 RPM/second. The speed of the basket 120 increases from the first prep speed 202 to a measurement speed 204 during the measurement ramp phase. Also during the measurement ramp phase, a plaster speed, e.g., a first plaster speed, of the load of articles in the basket 120 is calculated. After the measurement ramp phase, the rotation of the basket 120 is decelerated to zero, e.g., as indicated at 206 in FIG. 7.

Additionally, some embodiments may include determining a workable or optimum speed range for plastering the load of articles in the wash basket 120. For example, an optimum speed range may include the calculated plaster speed plus or minus a certain tolerance. The range may include speeds from a speed less than the calculated plaster speed by a first margin up to and including a speed greater than the calculated plaster speed by a second margin. The range may be centered on the calculated plaster speed, e.g., the first margin and the second margin may be equal, or, in alternate embodiments, the range may not be centered on the calculated plaster speed, e.g., the first margin and the second margin may differ.

Figure 8:
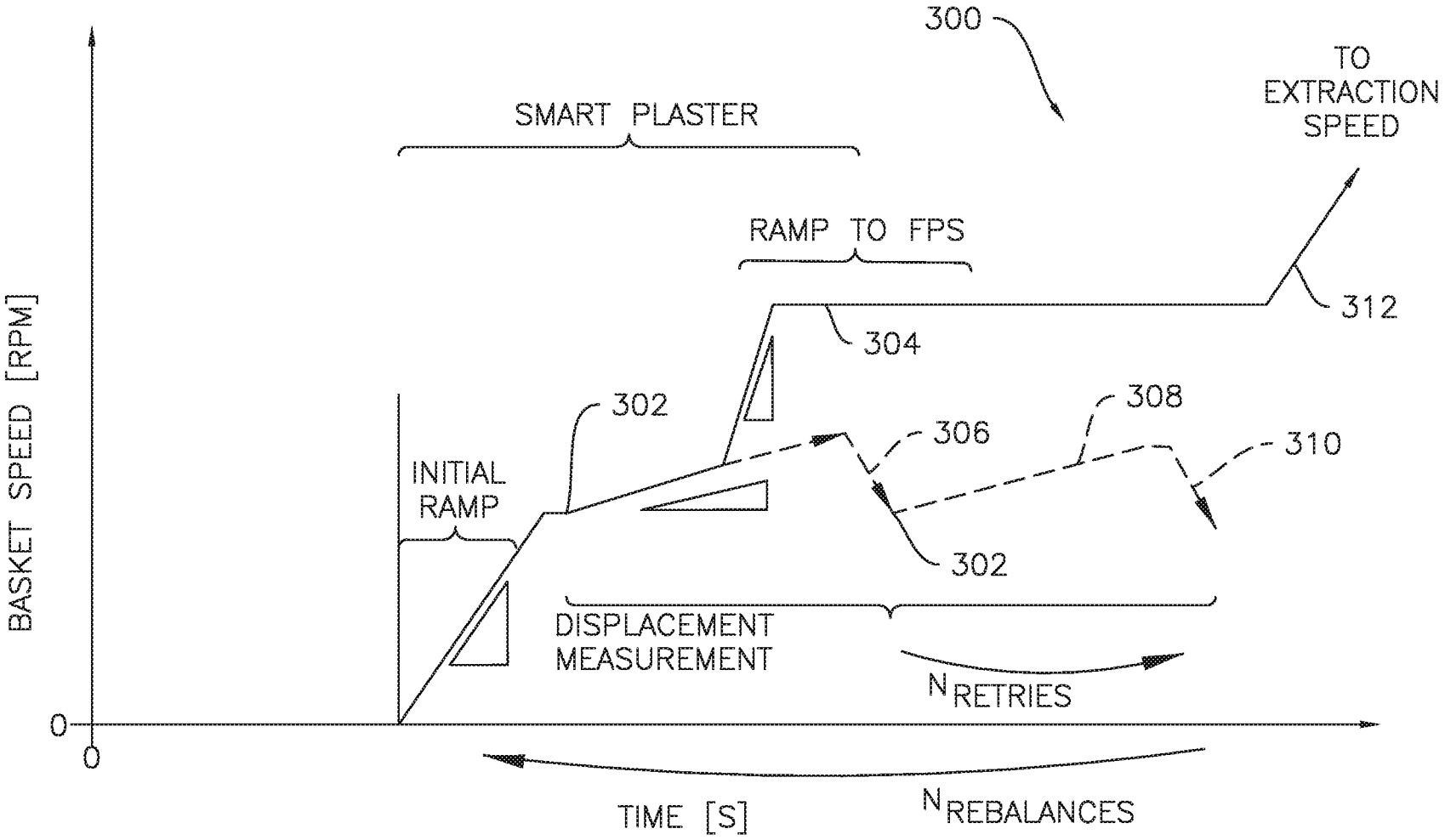
FIG. 8 provides a graph of rotational speed over time during an exemplary operation of a washing machine appliance according to one or more exemplary embodiments of the present disclosure.

Turning now to FIG. 8, a graph is provided of rotational speed over time during one example embodiment of a washing machine operation or cycle 300 including smart plastering. The graph of FIG. 8 begins after a prep step, such as the example prep step illustrated in FIG. 7. The prep step of FIG. 7 is but one possible example, additional or different steps for determining or calculating a plaster speed or first plaster speed may also be included as well as or instead of the example prep step illustrated in FIG. 7.

The smart plaster operation 300 illustrated in FIG. 8 includes an initial ramp phase wherein the rotational speed of the wash basket 120 is increased to a first speed 302 which is greater than zero and less than the calculated plaster speed and a ramp to FPS (Full Plaster Speed) phase wherein the rotational speed of the wash basket 120 is increased to a second speed 304 which is greater than the first speed. As mentioned above, after the prep step, the rotation of the basket 120 is decelerated to zero. Thus, as illustrated in FIG. 8, the smart plaster method may include rotating the basket, e.g., during the initial ramp phase wherein the rotational speed of the basket increases or ramps up to the first speed 302. The initial ramp phase may include accelerating the basket 120 to a first speed 302 that is less than the calculated first plaster speed. For example, the first speed 302 may be less than the calculated first plaster speed by a first margin. In various embodiments, the second speed 304 may be greater than the calculated full plaster speed, equal to the calculated full plaster speed, or less than the calculated full plaster speed. For example, in some embodiments, the second speed 304 may be within a predetermined margin of the calculated full plaster speed, e.g., the second speed 304 may be greater or less than the calculated full plaster speed by the predetermined margin. Also by way of example, in some embodiments, the second speed 304 may be greater than the calculated full plaster speed by a second predetermined margin, e.g., where the first speed 302 is less than the calculated full plaster speed by the first predetermined margin. It should be noted that the margins may be predetermined, e.g., in that one or more values for the margin(s) may be programmed into a memory of the controller 166 and such values may be constant values which are not changed and are re-used or reapplied across multiple operations of the washing machine appliance 100.

As indicated in FIG. 8, in some embodiments, the smart plaster operation 300 may include displacement measurement at least after reaching the first speed 302 that is less than the calculated first plaster speed, such as measuring displacement of the tub 124, e.g., using an accelerometer as described above. Such measurement may include repeated or continuous measurement, e.g., monitoring, of the balance condition of the load of articles in the basket 120. When the load of articles in the basket 120 is balanced, e.g., when the monitored balance condition is within a predetermined tolerance range, such as an OOB value is within the predetermined tolerance range, e.g., less than or equal to an upper limit of the predetermined tolerance range, the basket 120 may be accelerated to full plaster speed. In at least some embodiments, accelerating to the full plaster speed when the monitored balance condition is within the predetermined tolerance range is performed because and as a result of the balance condition being within the predetermined tolerance range, such as only when the monitored balance condition is within the predetermined tolerance range.

In some instances, the basket 120 may be decelerated, e.g., as indicated by dashed line 306 in FIG. 8. For example, the basket 120 may be decelerated when an out-of-balance condition is detected, e.g., when an OOB value is above a predetermined maximum threshold, where the predetermined maximum threshold is greater than an upper limit of the predetermined tolerance range. As another example, the smart plaster operation 300 may also include a time out condition, e.g., a predefined period of time or time out period, such that the basket 120 may be decelerated when the monitored balance condition does not fall within the predetermined tolerance range during the time out period. For example, the basket 120 may be slowly accelerated during the time out period, such as accelerated by about five rotations per minute per second (5 RPM/s) or less, such as by about 2 RPM/s, such by as about 1 RPM/s. The time out period may be between about five seconds (5 s) and about thirty second (30 s), such as between about ten seconds (10 s) and about twenty seconds (20 s), such as about fifteen seconds (15 s). Preferably, the basket 120 may be decelerated to a speed greater than zero, unless the balance condition of the load of articles in the basket 120 has been failed to reach the predetermined tolerance range (e.g., the OOB value has remained above the predetermined tolerance range) after numerous time out periods over the course of a single plastering operation or method. For example, the basket 120 may be decelerated back to the first speed 302, where the first speed 302 is greater than zero. In additional embodiments, the basket 120 may be decelerated to any speed less than the second speed.

After decelerating the wash basket 120, e.g., back to the first speed 302, the basket 120 may again be accelerated, e.g., as illustrated by dashed line 308 in FIG. 8, allowing at least some of the articles therein to continue to tumble, e.g., where the load is partially plastered, articles closer to the center of the wash basket 120 may continue to tumble while articles at or close to the perimeter of the wash basket 120 are plastered to the wall of the basket 120. Thus, the load of articles in the wash basket 120 may be at least partly redistributed or rebalanced after the balance condition of the load of articles remained outside of the predetermined tolerance range until the time out period elapsed by rotating the wash basket at speeds less than the calculated plaster speed, such as starting at (or returning to) the first speed 302 and ramping up from there, e.g., along dashed line 308 as illustrated in FIG. 8. In various embodiments, certain steps may be reiterated if another or subsequent out-of-balance condition is detected and/or if the monitored balance condition does not reach the predetermined tolerance range. For example, the step of decelerating the basket 120, e.g., to the first speed 302, in response to the time out period elapsing and/or the OOB value exceeding the predetermined maximum threshold may be repeated, as indicated at 310 in FIG. 8, and may be followed by ramping back up in order to redistribute or re-balance the load. Additionally, the step of decelerating may include decelerating to a speed less than the most recently calculated plaster speed by the first predetermined margin. The speed changes may be repeated each time the time out period expires without the balance condition falling within the predetermined tolerance range. Thus, as noted in FIG. 8, the smart plaster operation may include multiple, e.g., "N" number, rebalances where the basket 120 is slowed to, e.g., the endpoint of the initial ramp phase, at 306 or 310, such as to the first speed 302, as well as N retries, where the rotation of the wash basket 120 is ramped back up, e.g., at 308 in FIG. 8, to try to achieve a balanced, fully plastered condition of the load of articles in the wash basket 120.

In some embodiments, there may be a limit to the number of iterations. As mentioned above, if the time out period has elapsed numerous times, such a N times (or N plus one times) over the course of a single plastering operation or method without the balance condition satisfying the predetermined tolerance range, the wash basket 120 may be decelerated to a speed less than the first speed 302, such as zero. In such instances, the plastering method may start over, which, in at least some embodiments, may include repeating the prep step 200 as well as the smart plastering operation 300.

In some embodiments, the plaster speed may be re-calculated, e.g., a second plaster speed may be calculated after decelerating the wash basket 120 to the first speed 302 when the monitored balance condition remains outside the predetermined tolerance range during the time out period. For example, the plaster speed may be re-calculated each time an out-of-balance condition is detected and/or after each instance of the time out period expiring without the monitored balance condition reaching the predetermined tolerance range.

Figure 9:
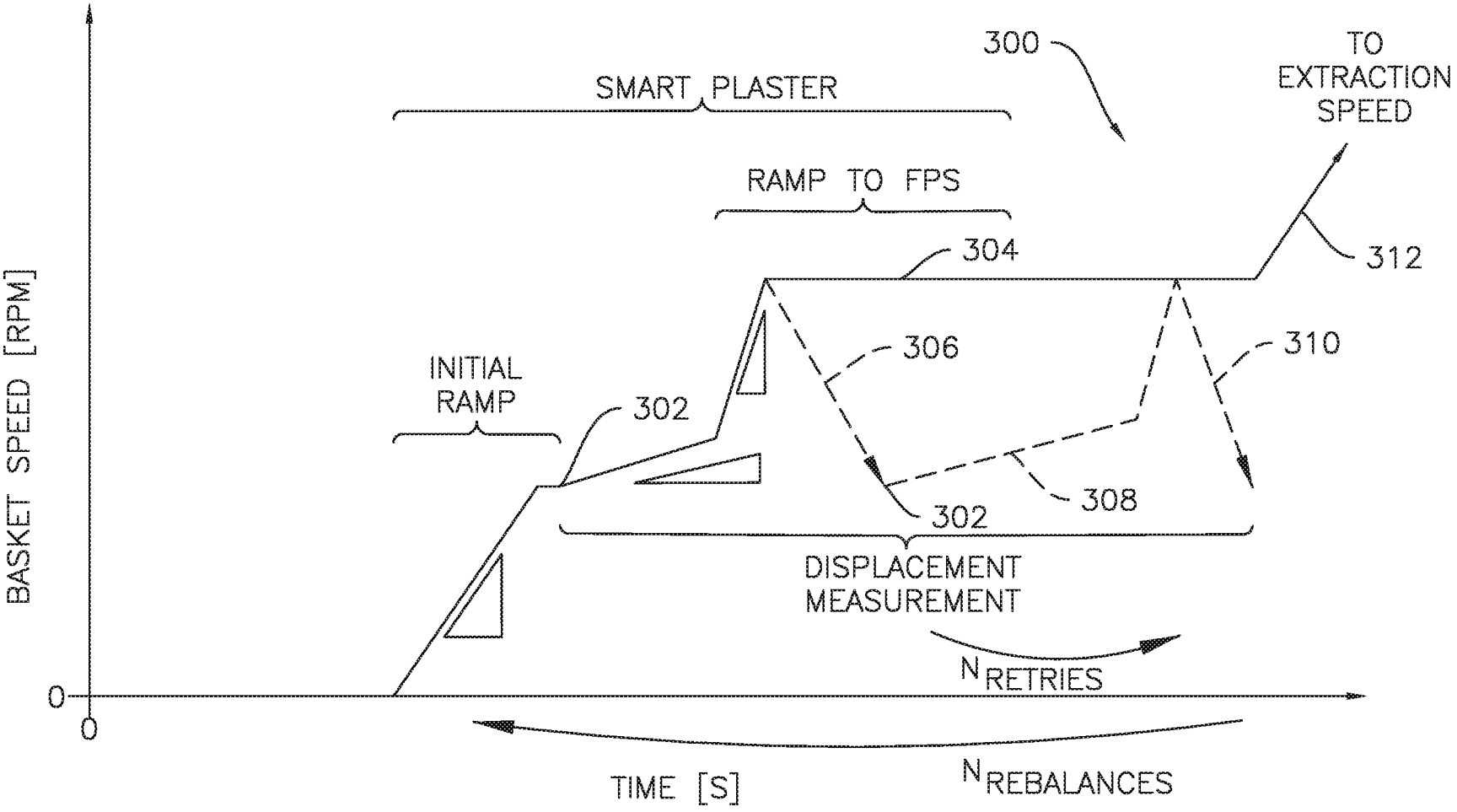
FIG. 9 provides a graph of rotational speed over time during an exemplary operation of a washing machine appliance according to one or more additional exemplary embodiments of the present disclosure.

FIG. 9 provides a graph of rotational speed over time during another example embodiment of a washing machine operation or cycle including smart plastering. The example illustrated in FIG. 9 is generally similar to that illustrated in FIG. 8. However, where lines 306, 308, and 310 in FIG. 8 depict an embodiment wherein the time out period elapsed prior to the wash basket 120 reaching the second speed 304 which is greater than the first speed, FIG. 9 depicts an embodiment where the or each time out period elapsed after accelerating the wash basket 120 to the second speed 304. In additional embodiments, combinations thereof are also possible. For example, a time out period may elapse prior to reaching the second speed, followed by decelerating the wash basket 120 in order to rebalance the load, and a second or other subsequent time out period may elapse after reaching the second speed 304.

Additionally, as indicated by the solid line in FIGS. 8 and 9, when the monitored balance condition is within the predetermined tolerance range, either in the initial attempt or after N or less retries or any other time prior to expiration of the time out period during acceleration or during deceleration, the basket speed may be increased to extraction speed at 312. It should also be noted that although FIGS. 8 and 9 illustrate the acceleration to full plaster speed occurring during or at the end of an acceleration phase of a displacement measurement, the acceleration to full plaster speed may also occur during a deceleration phase, e.g., at line 306 or 310, if and when the monitored balance condition falls within the predetermined tolerance range during the deceleration phase.

Figure 10:
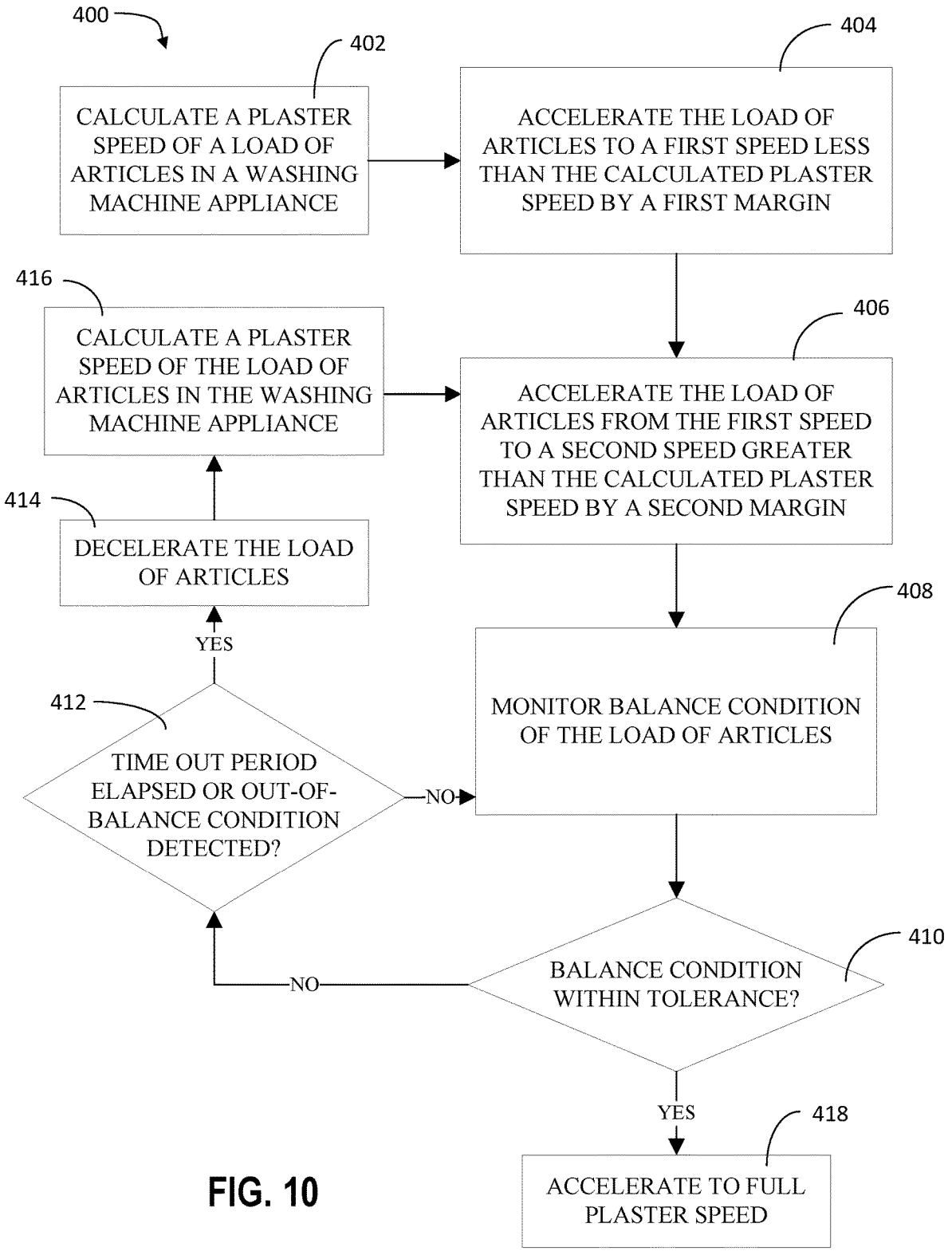
FIG. 10 provides a flow chart illustrating a method for operating a washing machine appliance in accordance with one or more exemplary embodiments of the present disclosure.
Figure 11:
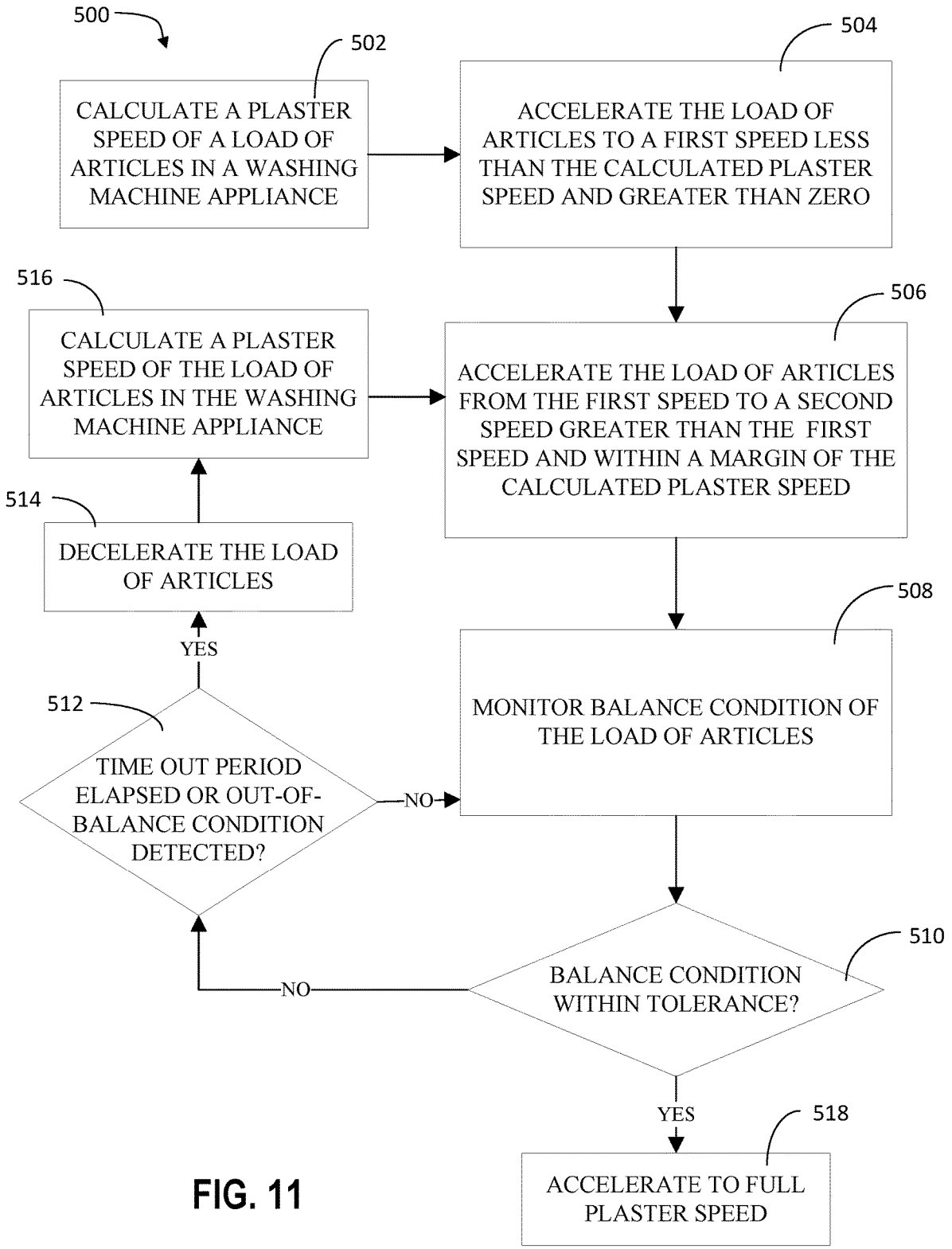
FIG. 11 provides a flow chart illustrating a method for operating a washing machine appliance in accordance with one or more additional exemplary embodiments of the present disclosure.

Referring now to FIGS. 10 and 11, various methods may be provided for use with washing machine appliances in accordance with the present disclosure. For instance, washing machine appliance 100 described herein can be utilized to implement methods 400 and/or 500. Accordingly, to provide context to methods 400 and 500, the numerals used above to denote various features of washing machine appliance 100 will be utilized below. The washing machine appliance 100, however, is only one example of several possible embodiments of a washing machine appliance which may be operated according to one or more of the disclosed methods. In general, the various steps of methods as disclosed herein may, in exemplary embodiments, be performed by the controller 166, which may receive inputs from and transmit outputs to various other components of the appliance 100. In particular, the present disclosure is further directed to methods, as indicated by reference numbers 400 and 500, for operating a washing machine appliance 100. Such methods advantageously facilitate monitoring of load balance states, ensuring favorable balance conditions prior to acceleration to full plaster speed, and reduction of out-of-balance conditions when favorable balance conditions are not detected. In exemplary embodiments, such balancing is performed during the spin cycle, following one or more of a draining cycle, wash cycle, rinse cycle, etc.

As illustrated at 402 in FIG. 10, the method 400 includes calculating a plaster speed of a load of articles in the washing machine appliance 100, e.g., in the basket 120 thereof. The plaster speed in step 402 may be a first plaster speed in some embodiments. The speed may be, e.g., a rotational velocity of the basket 120 or motor assembly 122. In some embodiments, the first plaster speed may be calculated during a prep step as described above, e.g., in reference to FIG. 7. Additionally, in at least some embodiments, the method 400 may include rotating the basket 120 or rotating an agitator within the tub 124 to rotate the articles therein.

In some embodiments, the step 402 follows a wash cycle or rinse cycle and may, furthermore, occur after tumbling or agitating articles within the tub (e.g., for an agitation period), and/or follow draining a volume of liquid from the tub. For instance, 402 may occur after flowing a volume of liquid into the tub. The liquid may include water, and may further include one or more additives as discussed above. The water may be flowed through hoses, a tube, and nozzle assembly into the tub and onto articles that are disposed in the basket for washing. The volume of liquid may be dependent upon the size of the load of articles and other variables which may, for example, be input by a user interacting with the control panel and input selectors thereof.

Still referring to FIG. 10, in some embodiments the method 400 may further include a step 404 of accelerating the load of articles, e.g., the basket 120 in which the load of articles are disposed, to a first speed less than the calculated plaster speed by a first margin. The method 400 may also include a step 406 of accelerating the basket from the first speed to a second speed. The second speed may be greater than the calculated first plaster speed, e.g., by a second margin. In some embodiments, the first margin may be equal to the second margin or, in alternate embodiments, the first margin may be different from the second margin. Thus, the method 400 may include rotating the articles within the washing machine appliance 100 through a range of speeds around the calculated plaster speed. Such range may be defined and bounded by the first margin and the second margin. For example, the first margin and the second margin may each be between about five rotations per minute (5 RPM) and about twenty-five rotations per minute (25 RPM), in various combinations, such that the total range may be between about ten rotations per minute (10 RPM) and about thirty rotations per minute (30 RPM). For example, the range may be about twenty rotations per minute (20 RPM), wherein the first margin and the second margin may each be about ten rotations per minute (10 RPM), or one of the first margin and the second margin may be about five rotations per minute (5 RPM) and the other of the first margin and the second margin may be about fifteen rotations per minute (15 RPM), among numerous other possible examples.

As illustrated at 408 in FIG. 10, some embodiments of the method 400 include monitoring for a balance condition of the articles in the washing machine appliance 100. Such balance monitoring or detection may be performed at least during the step of accelerating the basket from the first speed to the second speed and, in some embodiments, may also be performed before ramping up to the first speed and/or after ramping up to the second speed.

In some embodiments, the monitored balance condition of the load of articles in the basket may be compared to a predetermined tolerance range, e.g., at step 410 in FIG. 10. When the balance condition is not within the predetermined tolerance range, the method 400 may then include determining whether a time out period has elapsed, for example as illustrated at 412 in FIG. 10. Also as illustrated at 412 in FIG. 10, the method may also include determining whether an out-of-balance condition was detected, e.g., whether an OOB value is above a predetermined maximum threshold.

When the monitored balance condition of the load of articles in the basket is outside the predetermined tolerance range at step 410, but the time out period has not elapsed at step 412, and an out-of-balance condition has not been detected, e.g., the OOB value is greater than the predetermined tolerance range at step 410 but less than the predetermined maximum threshold at step 412, the method 400 may return to step 406 and/or 408 and continue to accelerate the load of articles, e.g., the basket of the washing machine in which the articles are disposed, while also continuing to monitor the balance condition of the load of articles.

When the monitored balance condition of the load of articles in the basket is outside the predetermined tolerance range at step 410, and the time out period has elapsed or when an out-of-balance condition is detected at step 412, e.g., when the determination at 412 in FIG. 10 is "YES" and leads to step 414 in FIG. 10, the method 400 may include decelerating the load of articles, e.g., the basket 120 in which the articles are received, to the first speed or to another speed less than the second speed, including zero and any speed between zero and the second speed.

As shown at 416 in FIG. 10, the method 400 may also include, after the time out period has elapsed or out-of-balance condition is detected at 412, calculating an additional or subsequent, e.g., second, plaster speed of the load of articles. In some embodiments, step 416 may begin concurrently with the step 414 of decelerating the basket, e.g., the second plaster speed may be calculated at the instant deceleration begins. In such instances, the method 400 may include rebalancing the articles and retrying the ramp to full plaster speed, e.g., returning to the step 406 after calculating the second plaster speed of the load of articles, where the speed in the step 406 is greater than the calculated second plaster speed calculated in step 416 by the second margin when the step 406 follows step 416, as illustrated in FIG. 10. For example, the speed in the step 406 may be referred to as a third speed when the 406 follows step 416 (or a fourth speed, fifth speed, etc., depending on the number of iterations).

Also as shown in FIG. 10, the method 400 may further include a step 418 of accelerating the load of articles, e.g., the basket 120 in which the articles are received, to full plaster speed and, in some embodiments, to extraction speed (see, e.g., FIGS. 8 and 9) when the balance condition is within the predetermined tolerance range. The step 418 may be performed after a first instance of steps 406 through 410, or after one or more iterations of rebalancing and retrying, such as proceeding through steps 412 through 416 then returning to step 406, e.g., as described in the preceding paragraph.

Another example method 500 is illustrated in FIG. 11. As may be seen in FIG. 11 at 502, the method 500 includes calculating a first plaster speed of a load of articles in the washing machine appliance 100, e.g., in the basket 120 thereof. The speed may be, e.g., a rotational velocity of the basket 120 or motor assembly 122. In some embodiments, the first plaster speed may be calculated during a prep step as described above, e.g., in reference to FIG. 7. Additionally, in at least some embodiments, the method 500 may include rotating the basket 120, e.g., starting from a zero speed after the prep step.

In some embodiments, the step 502 follows a wash cycle or rinse cycle and may, furthermore, occur after agitating articles within the tub (e.g., for an agitation period), and/or follow draining a volume of liquid from the tub. For instance, 502 may occur after flowing a volume of liquid into the tub. The liquid may include water, and may further include one or more additives as discussed above. The water may be flowed through hoses, a tube, and nozzle assembly into the tub and onto articles that are disposed in the basket for washing. The volume of liquid may be dependent upon the size of the load of articles and other variables which may, for example, be input by a user interacting with the control panel and input selectors thereof.

Still referring to FIG. 11, in some embodiments the method 500 may further include a step 504 of accelerating the load of articles, e.g., the basket 120 in which the load of articles are disposed, to a first speed which is less than the calculated first plaster speed and is greater than zero. The method 500 may also include a step 506 of accelerating the basket from the first speed to a second speed. The second speed may be greater than the first speed. Thus, the method 500 may include rotating the articles within the washing machine appliance 100, e.g., within the wash basket 120 thereof, through a range of speeds. In various embodiments, the total range may be between about ten rotations per minute (10 RPM) and about thirty rotations per minute (30 RPM), such as in the examples described above with respect to method 400 illustrated in FIG. 10. Additionally, the range of speeds may be at least in part based on the calculated plaster speed. For example, the second speed may be based on the calculated plaster speed, such as within a predetermined margin of the calculated plaster speed. In various embodiments, the second speed may be greater than the calculated first plaster speed by the predetermined margin, or the second speed may be less than the calculated first plaster speed by the predetermined margin. The predetermined margin may, in various embodiments, be about five rotations per minute (5 RPM), about ten rotations per minute (10 RPM), about twenty rotations per minute (20 RPM), or about thirty rotations per minute (30 RPM).

As illustrated at 508 in FIG. 11, some embodiments of the method 500 include monitoring a balance condition of the articles in the washing machine appliance 100, such as calculating one or more OOB values of the load, as described above. Such balance monitoring or detection may be performed at least during the step of accelerating the basket from the first speed to the second speed and, in some embodiments, may also be performed before ramping up to the first speed and/or after ramping up to the second speed.

In some embodiments, the monitored balance condition of the load of articles in the basket may be compared to a predetermined tolerance range, e.g., at step 510 in FIG. 11. When the balance condition is not within the predetermined tolerance range, the method 500 may then include determining whether a time out period has elapsed, for example as illustrated at 512 in FIG. 11. Also as illustrated at 512 in FIG. 11, the method may also include determining whether an out-of-balance condition was detected, e.g., whether an OOB value is above a predetermined maximum threshold.

When the monitored balance condition of the load of articles in the basket is outside the predetermined tolerance range at step 510, but the time out period has not elapsed at step 512 and an out-of-balance condition has not been detected, e.g., the OOB value is greater than the predetermined tolerance range but less than the predetermined maximum threshold, the method 500 may return to step 506 and/or 508 and continue to accelerate the load of articles, e.g., the basket of the washing machine in which the articles are disposed, while also continuing to monitor the balance condition of the load of articles.

When the monitored balance condition of the load of articles in the basket is outside the predetermined tolerance range at step 510, and the time out period has elapsed at step 512, or when an out-of-balance condition is detected, e.g., when the determination at 512 in FIG. 11 is "YES" for either of the two conditions, then method 500 proceeds from step 512 to step 514 in FIG. 11. Thus, the method 500 may include decelerating the load of articles, e.g., the basket 120 in which the articles are received, after the time out period has elapsed and/or at any time an out-of-balance condition is detected during the time out period. In some embodiments, the step 514 may include decelerating to the first speed. In additional embodiments, the step 514 may include decelerating to any speed, down to and including zero.

As shown at 516 in FIG. 11, the method 500 may also include, after the time out period has elapsed or out-of-balance condition is detected at 512, calculating an additional or subsequent, e.g., second, plaster speed of the load of articles. In some embodiments, step 516 may begin concurrently with the step 514 of decelerating the basket, e.g., the second plaster speed may be calculated at the instant deceleration begins. In such instances, the method 500 may include rebalancing the articles and retrying the ramp to full plaster speed, e.g., returning to the step 506 after calculating the second plaster speed of the load of articles, where the speed in the step 506 is within the predetermined margin of the calculated second plaster speed calculated from step 516 when the step 506 follows step 516, as illustrated in FIG. 11. For example, the speed in the step 506 may be referred to as a third speed when the 506 follows step 516 (or a fourth speed, fifth speed, etc., depending on the number of iterations).

Also as shown in FIG. 11, the method 500 may further include a step 518 of accelerating the load of articles, e.g., the basket 120 in which the articles are received, to full plaster speed and, in at least some embodiments, to extraction speed (see, e.g., FIGS. 8 and 9) when the balance condition is within the predetermined tolerance range. The step 518 may be performed after a first instance of steps 506 through 510, or after one or more iterations of rebalancing and retrying, e.g., as described in the preceding paragraph.

As may be seen, for example in the loop comprising steps 406, 408, 410, 412, 414, and 416 in FIG. 10 and/or the loop comprising steps 506, 508, 510, 512, 514, and 516 in FIG. 11, as well as the $N_{RETRIES}$ and $N_{REBALANCES}$ in FIGS. 8 and 9, in some embodiments the method 400 or 500 may further include calculating a subsequent plaster speed of the load of articles in the basket during or after the step of accelerating the basket to the second speed, third speed, or other subsequent speed. When the balance condition of the load of articles in the basket is not within the predetermined tolerance range and the time out period has elapsed a second time, the method may include decelerating the basket to a fourth speed less than the calculated second plaster speed and greater than zero. In some embodiments, the fourth speed may be less than the calculated second plaster speed by the first margin, e.g., the fourth speed is based on the second or other subsequent (most recent) calculated plaster speed, whereas the first speed was based on the originally calculated plaster speed or calculated first plaster speed. Further, the method may continue after the step of decelerating the basket to the fourth speed by calculating a subsequent plaster speed of the load of articles in the basket, and accelerating the basket to a subsequent speed greater than the fourth speed. The subsequent speed may be based on the calculated subsequent plaster speed, for example the subsequent speed may be greater than the calculated subsequent plaster speed by the second margin, or may be within the predetermined margin of the calculated subsequent plaster speed. The steps of (i) decelerating the basket to the first speed, (ii) calculating an additional subsequent plaster speed, and (iii) accelerating the basket to an additional subsequent speed within the margin of the calculated additional subsequent plaster speed or greater than the calculated additional subsequent plaster speed by the second margin, may be repeated in numerous iterations after each instance of the time out period elapsing.

In some embodiments, the number of iterations may be limited, and the load of articles, e.g., the basket 120 in which the load of articles are disposed, may be stopped, e.g., decelerated to a zero rotational speed, after reaching the limit of iterations. For example, in some embodiments, the limit may be about ten times or about five times. Thus, in various embodiments, the method may include decelerating the basket to zero speed after iterating the steps of (i) decelerating the basket to the first speed, (ii) calculating an additional subsequent plaster speed, and (iii) accelerating the basket to an additional subsequent speed within the margin of the calculated additional subsequent plaster speed or greater than the calculated additional subsequent plaster speed by the second margin ten times, or after five times, among other possible example limits.

In some embodiments, the balance condition of the load of articles in the basket may be detected or monitored based on measuring movement of the tub, such as during the step of accelerating the basket from the first speed to the second speed. As described above, measuring movement may include detecting movement of the tub as one or more displacement amplitudes or values using an accelerometer and a gyroscope. The displacement may be movement along the lateral direction (e.g., perpendicular to the axis of rotation). Additionally or alternatively, the measuring of movement may include measuring displacement at an effective center of gravity (e.g., for the tub or basket). The effective center of gravity is generally offset from a geometric center of gravity. For instance, the effective center of gravity may be offset along the Z-axis or transverse direction (e.g., parallel to the axis of rotation). The effective center of gravity may be a predetermined point calculated, for instance, from experimental data. Additionally or alternatively, the effective center may be the location (e.g., along the Z-axis) where the amplitude of $P_{XT}$ is approximately the same for any given out-of-balance mass located at any position along the transverse axis. Advantageously, the effective center of gravity may account for biasing forces or elements, such as the front baffle extending between the tub and the cabinet and biasing the tub along the Z-axis.

In some embodiments, detecting or monitoring the balance condition of the load of articles in the basket may include calculating an out-of-balance value as a function of a rotational velocity of the basket. For example, the out-of-balance ("OOB") value may be calculated based on a known or measured displacement value and rotational velocity using a predetermined graph, table, or transfer function, as described above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine appliance, the washing machine appliance having a tub and a basket rotatably mounted within the tub, the method comprising:

calculating a plaster speed of a load of articles in the basket;

rotating the basket;

accelerating the basket to a first speed less than the calculated plaster speed by a first margin;

accelerating the basket from the first speed to a second speed greater than the calculated plaster speed by a second margin;

monitoring a balance condition of the load of articles in the basket during the step of accelerating the basket from the first speed to the second speed;

accelerating the basket to a full plaster speed when the monitored balance condition is within a predetermined tolerance range;

accelerating the basket for a predefined period of time when the monitored balance condition of the load of articles is outside of the predetermined tolerance range;

decelerating the basket when the monitored balance condition of the load of articles remains outside of the predetermined tolerance range after the predefined period of time has elapsed or when an out-of-balance condition is detected;

calculating a second plaster speed of the load of articles in the basket while decelerating the basket; and accelerating the basket to a third speed greater than the calculated second plaster speed by the second margin.

2. The method of claim 1, further comprising decelerating the basket from the second speed after accelerating the basket from the first speed to the second speed, and wherein the step of monitoring the balance condition of the load of articles further comprises monitoring the balance condition of the load of articles during the step of decelerating the basket from the second speed to the first speed.

3. The method of claim 1, further comprising modulating the speed of the basket between the second speed and the first speed after accelerating the basket from the first speed to the second speed, and wherein the step of monitoring the balance condition of the load of articles further comprises monitoring the balance condition of the load of articles while modulating the speed of the basket.

4. The method of claim 1, further comprising, when the monitored balance condition is outside of the predetermined tolerance range during or after the step of accelerating the basket to the third speed, decelerating the basket to a fourth speed less than the calculated second plaster speed by the first margin, calculating a subsequent plaster speed of the load of articles in the basket after the step of decelerating the basket to the fourth speed, and accelerating the basket to a subsequent speed greater than the calculated subsequent plaster speed by the second margin.

5. The method of claim 4, wherein the subsequent speed is a first subsequent speed, further comprising iterating the steps of decelerating the basket to a speed less than the calculated subsequent plaster speed by the first margin, calculating an additional subsequent plaster speed, and accelerating the basket to an additional subsequent speed greater than the calculated additional subsequent plaster speed by the second margin when the monitored balance condition is outside of the predetermined tolerance range during or after the step of accelerating the basket to the first subsequent speed.

6. The method of claim 5, further comprising decelerating the basket to zero speed after iterating the steps of decelerating the basket, calculating the additional subsequent plaster speed, and accelerating the basket to the additional subsequent speed greater than the calculated additional subsequent plaster speed by the second margin ten times.

7. The method of claim 1, wherein the balance condition of the load of articles in the basket is monitored based on measuring movement of the tub, the measured movement is at least one of movement perpendicular to an axis of rotation within the basket and movement along a lateral direction, and wherein the predetermined tolerance range comprises a movement value less than a predetermined threshold.

8. The method of claim 1, wherein monitoring the balance condition of the load of articles in the basket comprises calculating an out-of-balance value as a function of a rotational velocity of the basket, and wherein the predetermined tolerance range comprises a maximum acceptable out-of-balance value.

9. A method of operating a washing machine appliance, the washing machine appliance having a tub and a basket rotatably mounted within the tub, the method comprising:

calculating a plaster speed of a load of articles in the basket;

rotating the basket;

accelerating the basket to a first speed less than the calculated plaster speed and greater than zero during an initial ramp period;

accelerating the basket from the first speed to a second speed, the second speed greater than the first speed and the second speed varies from the calculated plaster speed within a predetermined margin;

monitoring a balance condition of the load of articles in the basket;

accelerating the basket to a full plaster speed greater than the calculated plaster speed when the monitored balance condition is within a predetermined tolerance range;

accelerating the basket for a predefined period of time when the monitored balance condition of the load of articles is outside of the predetermined tolerance range;

decelerating the basket when the monitored balance condition remains outside of the predetermined tolerance range after the predefined period of time has elapsed or when an out-of-balance condition is detected;

calculating a second plaster speed of the load of articles in the basket after decelerating the basket; and accelerating the basket to a third speed, wherein the third speed is greater than the first speed and the third speed varies from the calculated second plaster speed within the predetermined margin.

10. The method of claim 9, further comprising decelerating the basket from the second speed after accelerating the basket from the first speed to the second speed, and wherein the step of monitoring the balance condition of the load of articles further comprises monitoring the balance condition of the load of articles during the step of decelerating the basket from the second speed.

11. The method of claim 9, further comprising modulating the speed of the basket between the second speed and the first speed after accelerating the basket from the first speed to the second speed, and wherein the step of monitoring the balance condition of the load of articles further comprises monitoring the balance condition of the load of articles while modulating the speed of the basket.

12. The method of claim 9, further comprising, when the monitored balance condition is outside of the predetermined tolerance range during or after the step of accelerating the basket to the third speed, decelerating the basket to a speed less than the third speed, calculating a subsequent plaster speed of the load of articles in the basket after the step of decelerating the basket to the speed less than the third speed, and accelerating the basket to a subsequent speed, the subsequent speed varies from the calculated subsequent plaster speed within the predetermined margin.

13. The method of claim 12, wherein the subsequent speed is a first subsequent speed, further comprising iterating the steps of decelerating the basket to the speed less than the third speed, calculating an additional subsequent plaster speed, and accelerating the basket to an additional subsequent speed that varies from the calculated additional subsequent plaster speed within the predetermined margin when the monitored balance condition is outside of the predetermined tolerance range during or after the step of accelerating the basket to the first subsequent speed.

14. The method of claim 13, further comprising decelerating the basket to zero speed after iterating the steps of decelerating the basket to the speed less than the third speed, calculating the additional subsequent plaster speed, and accelerating the basket to the additional subsequent speed that varies from the calculated additional subsequent plaster speed within the predetermined margin ten times.

15. The method of claim 10, wherein the balance condition of the load of articles in the basket is monitored based on measuring movement of the tub during the step of accelerating the basket from the first speed to the second speed, the movement is at least one of movement perpendicular to an axis of rotation within the basket and movement along a lateral direction, and wherein the predetermined tolerance range comprises a movement value less than a predetermined threshold.

16. The method of claim 10, wherein monitoring the balance condition of the load of articles in the basket comprises calculating an out-of-balance value as a function of a rotational velocity of the basket, and wherein the predetermined tolerance range comprises a maximum acceptable out-of-balance value.

17. The method of claim 9, wherein the second speed greater than the first speed is greater than the calculated plaster speed by the predetermined margin.

18. The method of claim 9, wherein the second speed greater than the first speed is less than the calculated plaster speed by the predetermined margin.

* * * * *